United States Patent [19]

Gysin

[11] 4,065,841

[45] Jan. 3, 1978

[54] PRINTING ROLLER

[76] Inventor: Max Gysin, 279 Marlin St., Dix Hills, N.Y. 11746

[21] Appl. No.: 716,683

[22] Filed: Aug. 23, 1976

[51] Int. Cl.[2] ..... B41F 31/00

[52] U.S. Cl. ..... 29/121.1

[58] Field of Search ..... 29/121.1, 121.4, 121.8, 29/120

[56] References Cited

U.S. PATENT DOCUMENTS

| | | | |
|---|---|---|---|
| 1,457,276 | 5/1923 | Isherwood | 29/121.4 X |
| 1,568,401 | 1/1926 | Griffith | 29/121.4 |
| 2,176,835 | 10/1939 | Cumfer | 29/121.4 X |
| 2,616,367 | 11/1952 | Sprung | 29/121.8 X |
| 2,675,596 | 4/1954 | Singer | 29/121.8 X |

*Primary Examiner*—Alfred R. Guest

*Attorney, Agent, or Firm*—Bauer, Amer & King

[57] ABSTRACT

An improved dampening roller produced by grinding a thermoplastic cylinder under conditions causing strands of the thermoplastic material to be abraded away from the surface and redeposited onto the still soft surface of the thermoplastic cylinder and to bond thereto. The particles are deposited at an angle, producing channels which permit edge removal of excess dampening solution, preventing liquid buildup at the center of the roller.

6 Claims, 7 Drawing Figures

PRINTING ROLLER

BACKGROUND OF THE INVENTION

This invention relates to a roller construction and, more particularly, to a dampening roller for use on a lithographic printing press.

In the operation of a lithographic printing press the parts of the plate which do not bear the image are dampened with water or a suitable solution to prevent the inking up of those parts of the plate. The ink is repelled from these portions of the plate because of its oil base and these portions of the plate stay clean. Dampening rollers are used to achieve this object.

DESCRIPTION OF THE PRIOR ART

The dampening rollers in general use in the past have included rollers covered with absorbent moleskin paper, or molleton, sewn over a metal core, acting as a water reservoir. These rollers are very hard and wear the plates and the molleton covering has to be replaced very frequently because the cotton loses its absorbency when compressed. The cotton becomes impregnated with the oily ingredients of the ink, thereby carrying an insufficient amount of dampening solution. The molleton covering also has a tendency to slip under pressure.

Still other dampening rollers are of the sponge rubber type where a solid rubber material is vulcanized to a roller and an outer sponge rubber-like layer with water retentive qualities surrounds and is united with the inner layer. These rollers have uneven surfaces which require careful grinding and are subject to wear upon continuous use to require frequent replacement.

SUMMARY OF THE INVENTION

In accordance with the present invention there is provided a dampening roller and method of manufacture. The dampening roller will not lose its water retention or absorbency for many months of use and needs no final surface grinding prior to use. The roller consists of a thermoplastic resin, such as PVC (Polyvinylchloride) of sufficient thickness to withstand the stresses of continuous operation. The surface of this roller is abraded with a carbide grinding wheel prior to use. This produces a stippled effect caused by the depositing on the surface of the roll of molten strands of PVC. The resulting surface can retain sufficient water for effective use in a lithographic printing press. The use of selective angular carbide grinding relative to the PVC roller axis provides a channel effect on the roller surface. The channels provide an edge removal of the excess dampening solution.

Therefore, this invention provides a dampening roller of long life, ease of manufacture and edge removal of excess water.

The above description, as well as further objects, features and advantages of the present invention, will be more fully appreciated by reference to the following detailed description of the presently preferred, but, nonetheless illustrative, embodiment in accordance with the present invention when taken in conjunction with the accompanying drawings.

DESCRIPTION OF THE PREFERRED EMBODIMENT

The rollers of the present invention are manufactured from any thermoplastic composition that can be cast onto a mandrel and cured to a conforming roller shape. An example of these materials is Polyvinylchloride (hereinafter called PVC). The process of making the roller consists preferably of placing a mandrel into a cylindrical mold and filling the mold with liquid PVC and curing the resin. After hardening the roller on its mandrel is removed from the mold, and the surface is ground to produce the stippled effect shown in FIG. 2.

Figure 1:
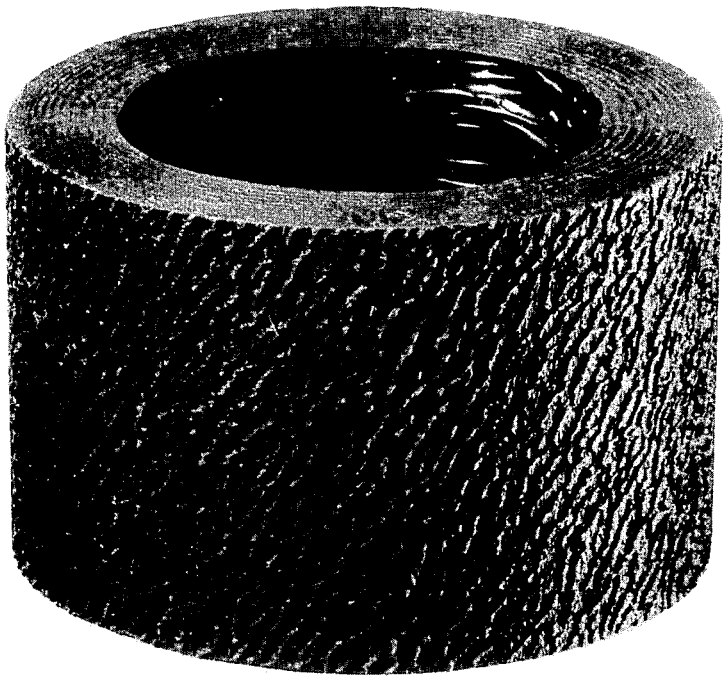
FIG. 1 is a photograph of a section of a roller made in accordance with this invention.
Figure 3:
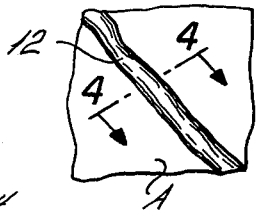
FIG. 3 is an enlarged plan view of a small section of the surface of the roller.
Figure 7:
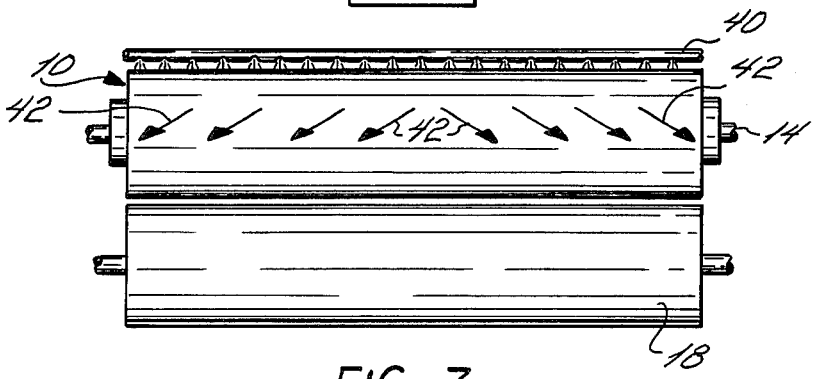
FIG. 7 is a plan view of the finished roller deployed in an offset printing press.
Figure 4:
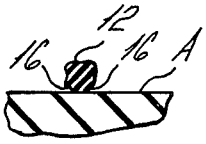
FIG. 4 is a section taken along line 4—4 of FIG. 3.

As shown in FIG. 1, the surface of the roller 10 contains a number of strands 12, of thermoplastic material arranged in substantially parallel rows at an angle to the central axis 14 of the roller. In FIG. 3 there is shown a small area A enlarged to show a typical strand 12. The vertical section of FIG. 4 discloses that the strand is bonded along a longitudinal edge to the roller forming interstices 16 which permit liquids to collect therein. PVC is readily deformable and when the roller is squeezed, as by a mating roller 18 (FIG. 7) it will force the liquid out from the interstices.

The surface of the roller is ground by mounting it in a lathe 20 (shown schematically in FIG. 5) and rotated by motor 22. A lead screw 25 is coupled to motor 22 by gear train 24 to move carriage 26. A grinding wheel 28 preferably of the carbide type, and driven by motor 30 through belt drive 32, is supported on the carriage to traverse the roller.

Figure 2:
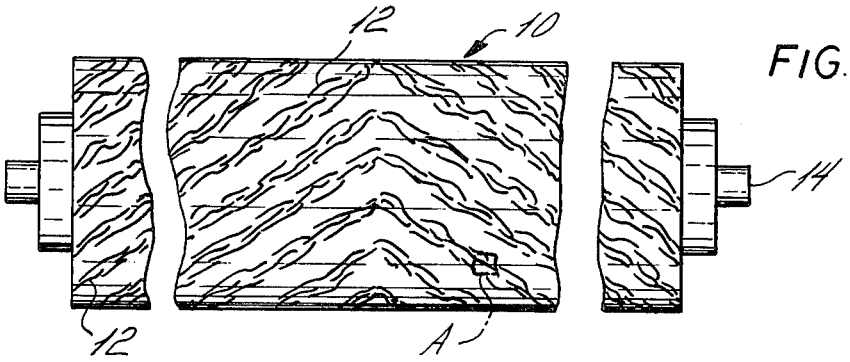
FIG. 2 is a plan view of a dampening roller of this invention as mounted on an axle shaft in which the stipling represents the abraded surface portions of the roller.
Figure 5:
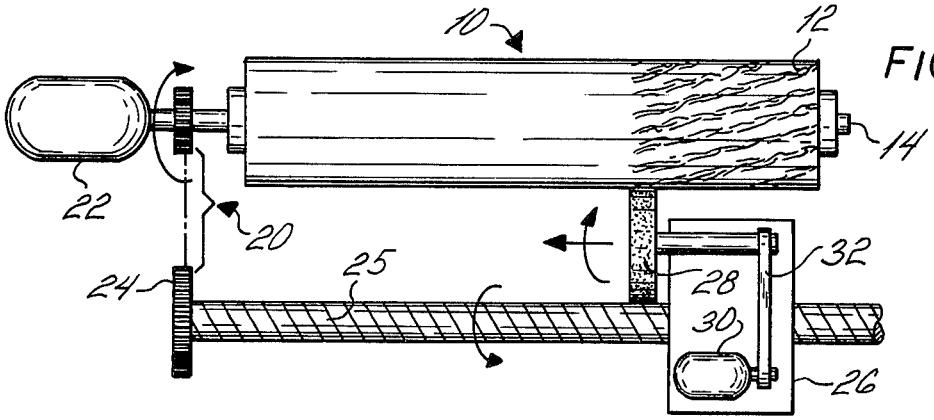
FIG. 5 is a plan view of a roller grinding machine with a partially ground roller positioned in the machine.
Figure 6:
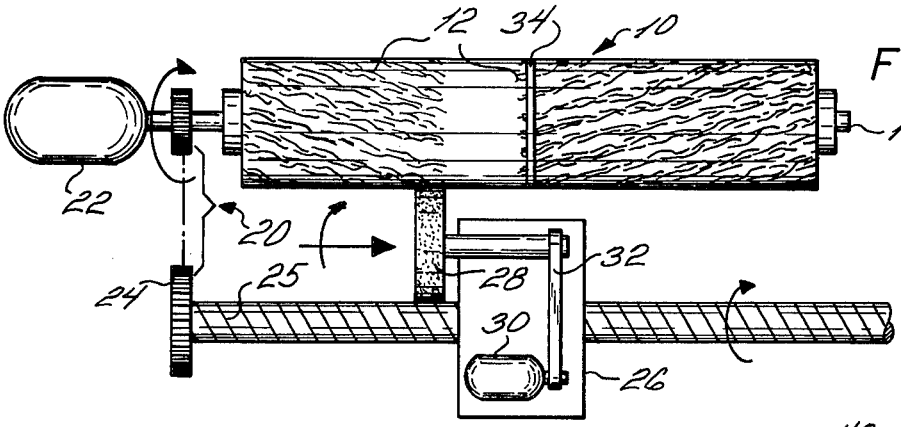
FIG. 6 is a plan view of the roller grinding machine of FIG. 2 with the roller in a more advanced stage of processing.

As shown in FIG. 5 the grinder is traversing from right to left. After grinding past the middle, a piece of tape 34 is placed around the roller at the middle. The roller is then ground from left to right as shown in FIG. 6. The tape is then removed leaving an intersecting herringbone pattern such as shown in FIG. 2.

Typically, the roller is rotated at about 200 to 500 RPM.

Thus, a 6 inch diameter roller would be turned at 250 RPM whereas a 3 inch roller would be turned at say 450 RPM. The grindstone could be a 6 inch diameter by ¼ inch wide carbide wheel rotating at 3400 RPM while traversing at the rate of about 8 inches per minute. The peripheral grinding rate should be in the order of 50,000 to 100,000 inches per minute.

This grinding procedure causes the removal of particles from the surface of the roller in the shape of elongated strands, which fly off at an angle and are redeposited onto the surface of the roller. Since the material is a thermoplastic, it softens and immediately bonds to the strand being redeposited on its surface. Because the particles fly off at an angle a herringbone pattern results. By varying the relative speed of rotation the particle size can be varied to obtain a very, very fine, closely packed surface, which is fuzz-like, or a coarser surface, such as shown in FIG. 1.

The roller in actual use would be wet with water or other liquid from a source 40. The herringbone pattern would tend to force the water to the outer edges as shown by arrows 42.

The presently preferred thermoplastic materials are Polyvinylchloride and Polyurethane.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A roller for the application of liquid substances having a mandrel extending longitudinally along a central axis comprising:

a. a sleeve of thermoplastic material coaxially surrounding said mandrel and affixed thereto; and b. a plurality of discrete isolated elongated compressible strands of said thermoplastic material integral with said sleeve along longitudinal narrowed connecting portions of said strands to space portions of said strands from said sleeve for forming liquid collection pockets therebetween, whereby the liquid in the liquid collection pockets is forced outward therefrom when said elongated strands are compressed toward said sleeve.

2. The roller of claim 1 wherein said strands are aligned in parallel relationship.

3. The roller of claim 1 wherein said thermoplastic material is a polyurethane.

4. The roller of claim 1 wherein said thermoplastic material is a polyvinylchloride.

5. The roller of claim 1 wherein said strands are aligned at an angle to the said axis.

6. The roller of claim 1 wherein half of said strands are arranged in substantially parallel rows at a first angle and the other half of said strands are arranged in substantially parallel rows at a second angle equal to said first angle, said first and second angles intersecting each other.

* * * * *